US006502781B1

(12) United States Patent
Tramontina

(10) Patent No.: US 6,502,781 B1
(45) Date of Patent: Jan. 7, 2003

(54) DISPENSER APPARATUS AND METHOD

(75) Inventor: Paul Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/461,952

(22) Filed: Dec. 15, 1999

(51) Int. Cl.[7] ..... B65H 23/06

(52) U.S. Cl. ..... 242/423.2; 242/596.5; 242/596.7; 242/596.8

(58) Field of Search ..... 242/423.2, 596.5, 242/596.7, 596.8, 423.1, 588.6; 312/34.8

(56) References Cited

U.S. PATENT DOCUMENTS

| | | | | |
|---|---|---|---|---|
| 1,057,614 A | * | 4/1913 | Bedell et al. | 242/596.5 |
| 2,819,852 A | | 1/1958 | Sarro | |
| 2,879,012 A | | 3/1959 | Sarro | |
| 3,095,996 A | | 7/1963 | Babin | |
| 3,281,032 A | | 10/1966 | Solomon | |
| 3,494,518 A | | 2/1970 | Goss | |
| 3,632,017 A | | 1/1972 | Matthews | |
| 3,865,295 A | | 2/1975 | Okamura | |
| 4,098,469 A | | 7/1978 | McCarthy | |
| 4,135,678 A | | 1/1979 | Williams | |
| 4,306,687 A | | 12/1981 | Hadtke | |
| 4,383,656 A | | 5/1983 | Campbell | |
| 4,398,656 A | | 8/1983 | McCadden | |
| 4,444,359 A | | 4/1984 | Butler | |
| 4,564,148 A | | 1/1986 | Wentworth | |
| 4,614,312 A | | 9/1986 | Del Pino | |
| 4,634,067 A | | 1/1987 | Whit | |
| 4,774,799 A | | 10/1988 | Durant | |
| 4,811,878 A | | 3/1989 | Horinchi | |
| 4,832,271 A | | 5/1989 | Gleziunas | |
| 4,877,154 A | | 10/1989 | Matsui | |
| 5,000,393 A | | 3/1991 | Madsen | |
| 5,058,792 A | | 10/1991 | Morand | |
| 5,149,003 A | | 9/1992 | Tharp | |
| 5,170,958 A | | 12/1992 | Brown | |

(List continued on next page.)

FOREIGN PATENT DOCUMENTS

| | | |
|---|---|---|
| EP | 0276662 | 8/1988 |
| EP | 0276662 A1 | 8/1988 |
| EP | 0729724 A1 | 9/1996 |
| FR | 1407112 | 6/1964 |
| FR | 1407112 A | 11/1965 |
| WO | WO99/12461 | 3/1999 |
| WO | WO9912461 A | 3/1999 |

OTHER PUBLICATIONS

U.S. Patent Ser. No. 09/537,275, Tramontina et al., "Dispenser Apparatus and Method", filed Mar. 29, 2000 KCX–235 (15185).

PCT Patent S/N PCT/US 00/32804 Search Report, Kimberly–Clark Worldwide, Inc., filed Apr. 12, 2000 KCX–234–PCT (14775).

*Primary Examiner*—John Q. Nguyen
(74) *Attorney, Agent, or Firm*—Dority & Manning

(57) ABSTRACT

A method and apparatus for more efficiently and easily dispensing paper products, such as toilet tissue, from commercial wall mounted dispensers. The dispenser may be reloaded, in most instances, in a single operation that requires only one hand. Further, the housing protects the paper from vandals and improper tampering, while still being configured for a simple reloading procedure without the necessity for using keys and the like to gain access to the housing. The apparatus may comprise spring loaded projections on the interior of the housing that are adapted to receive and suspend within the housing rolls of paper tissue. Doors within the housing are configured to allow insertion of a new roll of paper into the dispenser when located in the open position; further, such doors suspend the tail of the paper roll for easy access to the tissue user when the doors are in the closed position.

21 Claims, 17 Drawing Sheets

U.S. PATENT DOCUMENTS

| | | | | |
|---|---|---|---|---|
| 5,172,840 | A | | 12/1992 | Bloch |
| 5,253,818 | A | | 10/1993 | Craddock |
| D351,520 | S | | 10/1994 | Frazier et al. |
| 5,454,500 | A | | 10/1995 | Chen |
| 5,509,593 | A | | 4/1996 | Bloch |
| 5,601,253 | A | | 2/1997 | Formon |
| 5,618,008 | A | | 4/1997 | Dearwester et al. |
| 5,620,148 | A | | 4/1997 | Mitchell |
| 5,645,244 | A | | 7/1997 | Moody |
| 5,697,576 | A | | 12/1997 | Bloch et al. |
| 5,829,710 | A | | 11/1998 | Halle |
| 5,833,169 | A | | 11/1998 | Morand |
| 5,868,335 | A | | 2/1999 | LeBrun |
| 5,875,985 | A | | 3/1999 | Cohen |
| 5,884,804 | A | | 3/1999 | King |
| 5,915,645 | A | | 6/1999 | Granger |
| 5,954,256 | A | | 9/1999 | Niada |
| 6,092,758 | A | * | 7/2000 | Gemmell ..... 242/596.4 |
| 6,105,898 | A | | 8/2000 | Byrd et al. |

* cited by examiner

DISPENSER APPARATUS AND METHOD

FIELD OF THE INVENTION

This invention relates to dispensing apparatus and methods, and in particular rolled paper dispensing apparatus for delivering in an efficient manner absorbent paper products such as toilet tissue, paper towels and the like. More specifically, this invention pertains to a dispenser capable of receiving new rolls of paper product, with or without a core.

BACKGROUND OF THE INVENTION

Commercial and consumer absorbent paper products typically are distributed and dispensed from rolls. Rolled paper products may be dispensed, stored and maintained using a hollow cylindrical core which forms the support structure about which the paper is wrapped. Most paper toweling and consumer toilet tissue products contain a cardboard core, and the rolled product is often dispensed by mounting the core on a spindle, which passes through the core of the roll. In some cases, a mounting structure operatively engages each end of the core, thereby suspending the rolled product to facilitate dispensing of the paper.

Large or jumbo sized toilet tissue rolls are dispensed in restrooms of commercial buildings and in other locations where high volumes of rolled paper products are needed. Typically, these large size rolls include a core in the center of the roll. Usually, the rolls are mounted in dispensers so that the core of the roll is supported on an axis of rotation within the dispenser housing. These large size rolls may be largely invisible to the consumer, as they often are protected in a locked housing which dispenses the paper to the user at its lower margin or edge.

Some conventional large roll dispensers include a housing cover that can be removed only with a key to facilitate reloading the dispenser. Other dispensers employ a hinged housing cover which must opened or moved laterally to facilitate reloading the dispenser. Reloading dispensers is a time consuming task for maintenance personnel. In general, it is desirable to provide a process for reloading dispensers in a manner that is efficient and simple. One challenge in commercial dispenser design is to provide a dispenser that may be reloaded easily and quickly, but still offers security to the rolled paper product, thereby protecting the dispenser contents from vandalism and theft.

Coreless rolls of paper product are employed in applications where it is desirable to avoid using a core in the center of the rolled product. Coreless rolled products may be manufactured as provided in U.S. Pat. No. 5,620,148 to form a depression in the side of the roll that facilitates supporting and dispensing the roll. Devices capable of dispensing coreless rolled paper products have been disclosed as provided for example in U.S. Pat. No. 5,697,576. Another patent, U.S. Pat. No. 5,875,985, is directed to a method of treating a coreless roll to create a mounting hole in at least one end of the roll to provide a self-supporting roll for mounting in a rotary dispenser.

SUMMARY OF THE INVENTION

An assembly for dispensing an absorbent paper roll is provided having an interior space and an exterior cover. The assembly includes opposed support members, wherein the support members are adapted to engage sides a paper roll. The support members are mounted on the interior of the housing in spaced relation to each other. In some embodiments of the invention, there are projections within the interior space of the housing. The projections are adapted to engage the sides of the paper roll to form a fixed mounting axis from which the roll may be dispensed. Further, the assembly is adapted for automatically receiving and mounting a paper roll within the interior space of the housing upon the insertion of the paper roll into the housing.

The invention comprises a method and apparatus for more efficiently and easily dispensing paper products, such as toilet tissue, from commercial wall mounted dispensers. The dispenser may be reloaded, in most instances, by way of a single operation that usually requires only one hand. Further, the housing protects the paper a simple reloading procedure without the necessity for using keys and the like to gain access to the housing. The invention may comprise spring loaded projections on the interior of the housing that are adapted to receive and suspend within the housing rolls of paper tissue. Doors within the housing are configured to allow insertion of a new roll of paper into the dispenser when located in the open position. Further, such doors suspend the tail (end) of the paper roll for easy access to the tissue user when the doors are in the closed position.

In one embodiment, the projections are spring loaded. The opposed support members are biased against the sides of the paper roll in one configuration of the invention. The paper roll may contain a core, or alternatively, may be coreless. If the paper roll is coreless, the roll is supported within the housing by projections capable of articulating with indentations or spaces in the sides of the paper roll.

An assembly for dispensing a coreless absorbent paper roll is presented including a housing having an interior space and an exterior cover. Further, opposed support members are adapted to engage the sides a paper roll, the support members being mounted on the interior of the housing in spaced and tensioning relation to each other within the housing, The assembly is adapted for automatically receiving and mounting a paper roll within the interior space of the housing upon insertion of the roll into the housing. The assembly may comprise a release mechanism to facilitate the release and removal of a paper roll from the assembly prior to depletion of the paper roll. In one embodiment, the assembly includes at least one door capable of holding the tail of a paper roll in spaced relation to the housing. The opposed support members typically are flexible, thereby facilitating engagement with opposite sides of the roll as it is inserted into the housing.

At least one projection is actuable between: (a) a fully erect position for engaging a mounted paper roll, and (b) a disabled position to facilitate removal of a mounted paper roll from the assembly. Removal of a paper roll may be desirable, for example, when only one-half of the roll is remaining in the dispenser, and a period of heavy use is anticipated in the near future. The ability to remove a partially dispensed roll assists in preventing the depletion of the roll during a time when no maintenance personnel are available to refill the dispenser, and also when a roll is contaminated. In some embodiments, a release bar is used to actuate a projection, thereby enabling removal of a partially dispensed roll. The release bar may slidably engage the projection to disable the projection, thereby facilitating the removal of a paper roll from the assembly.

The method of mounting an absorbent paper roll in a dispenser is also provided. The paper roll is placed adjacent to the dispenser and in alignment with the dispenser housing, the dispenser housing having elongated support members on its interior. Then, one may insert the paper roll into the housing. Elongated support members may be engaged on each side of the paper roll, activating projections on each side of the paper roll. The paper roll may be supported by articulation of the projections with sides of the paper roll, wherein the paper roll is mounted within the housing and is capable of dispensing paper to the exterior of the housing. The projections may be bullet-shaped spring-loaded units.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made to this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Figure 1:
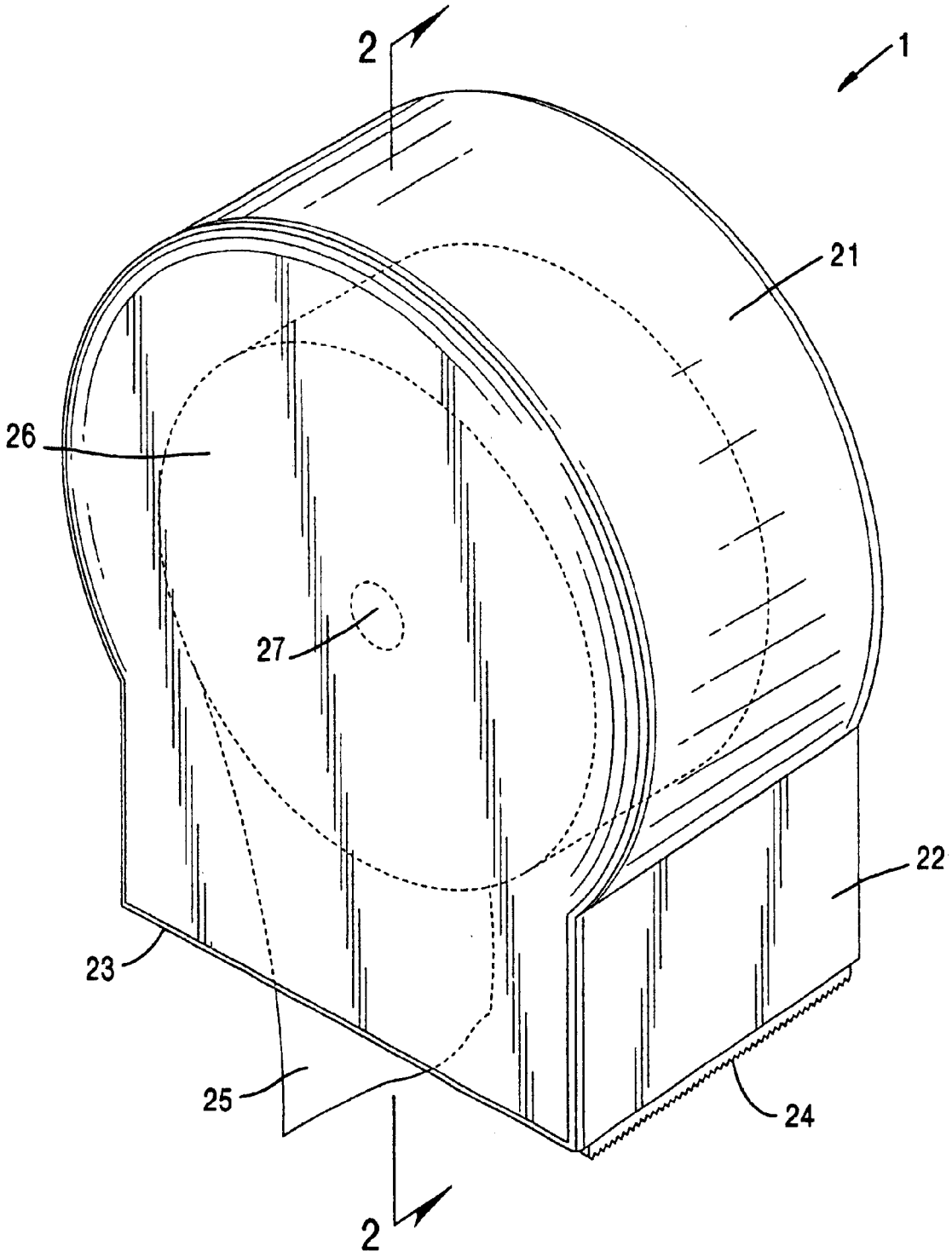
FIG. 1 is a perspective view of the dispenser.

Turning to FIG. 1, a dispenser 1 is shown with a housing 21 having a flat side 22 and a lower edge 23. Serrated edge 24 at the lower margin of the housing serves as a tear point for paper dispensed from the housing. Tissue tail 25 is available to users below the housing. The housing is typically mounted on a restroom wall or stall, and mounting blocks with screw holes are typically provided on the mounting side of the dispenser (not shown in Figures). A paper roll 26 having a relatively large size (8 inches in diameter is typical in the industry) is provided in the dispenser as shown in the Figure by dashed lines.

Figure 2:
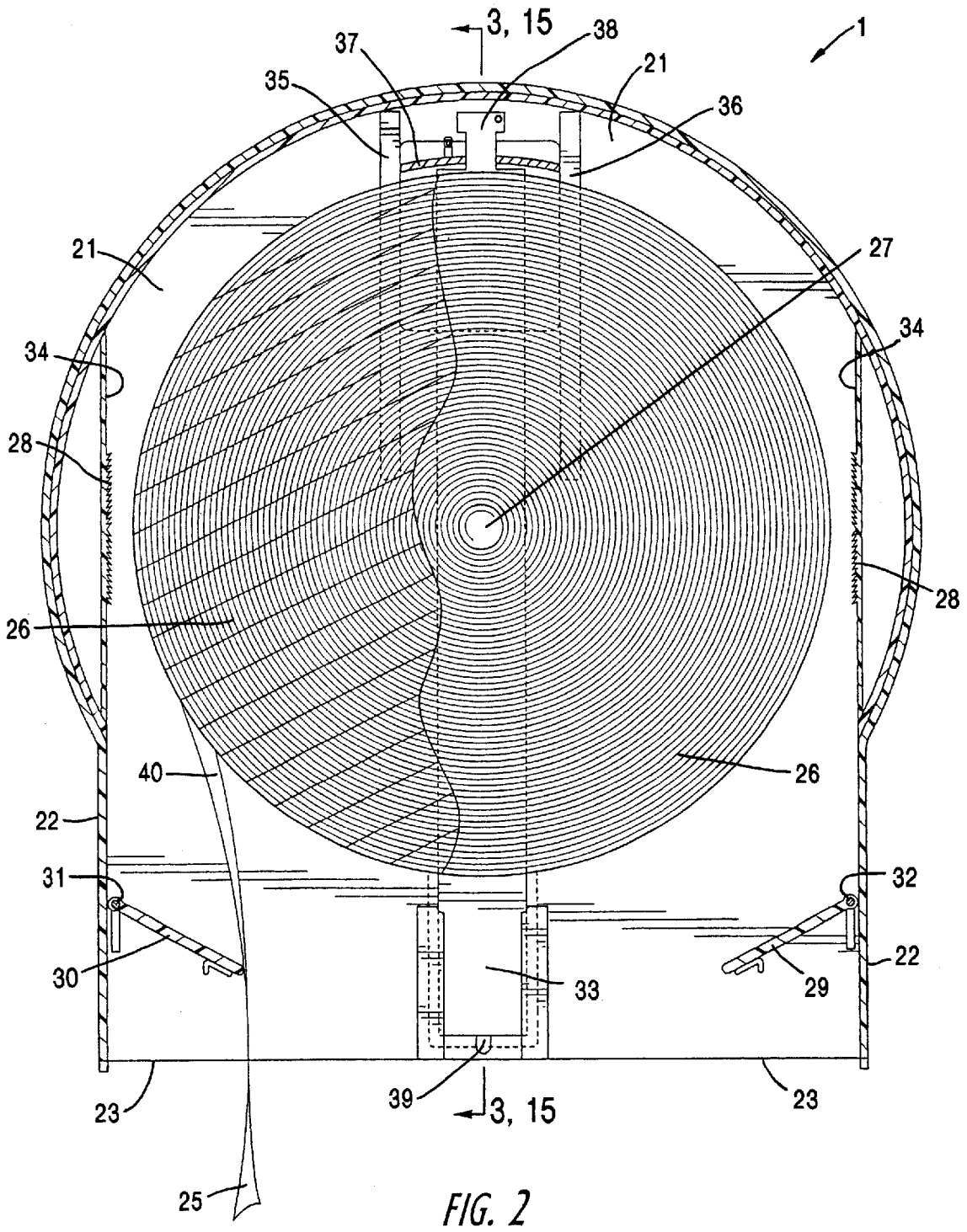
FIG. 2 shows a side cross-sectional view of the dispenser.

FIG. 2 shows a cross-sectional view of the dispenser with bombay doors 29 and 30. Hinges 31 and 32 provide articulation for movement of the bombay doors from an open position to accommodate the insertion of a new paper roll to the closed position in which they act to suspend the paper tail 25 within reach by the user. Release bar 33 is an optional feature that facilitates the removal of a paper roll from the dispenser, as further discussed below in connection with FIGS. 17 and 18. Interior housing 34 and centering ribs 35 and 36 form a cavity for the paper roll 26. Plate 37 at the upper portion of the housing forms a curved surface against which the paper roll may be pushed to engage the t-bar 38 and thereby activate projections which articulate with indentations 27 on either side of the paper roll, as will be further discussed below. Spring cavity 39 is a hollow space in which a spring may be placed for providing tensioning downward force on support members 43 and 44 (see FIG. 3). Tissue 40 is unwound from roll 26 and is held in spaced relation to the housing lower margin for convenient access by the user. Spring 42 provides a tensioning force between support 47 and strut 65.

Figure 5:
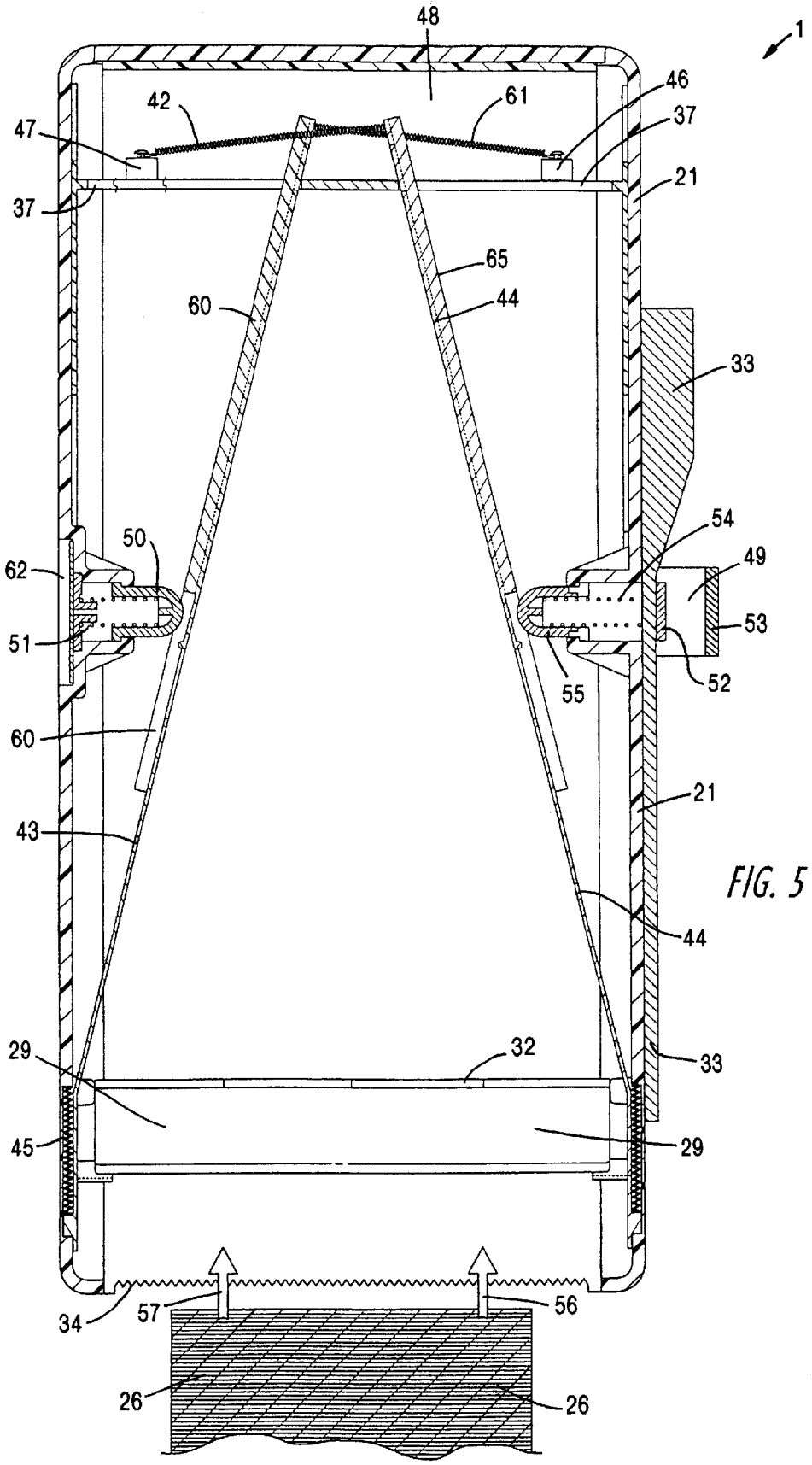
FIG. 5 shows a side view of the dispenser including the first step of FIG. 4 illustrating the loading of a paper roll into the dispenser.

Support members 43 and 44 engage the sides of the roll and flex during insertion of the roll. The support members are free to bend about their long axis when loaded with force. The support members are free to travel vertically, and rest on springs. Spring 45 and spring 41 each provide a tensioning force for support members 43 and 44. Supports 46 and 47 connect to the ends of springs 42 and 61 (see FIG. 5 as well). Space 48 above the roll provides the roll with room to rotate and to be inserted into the dispenser. Serrated gripping plate 28 on either side of the housing provides a frictional stop to the roll in the event the paper roll is misaligned in the housing, or in the event an improperly cored or sized roll is inserted into the dispenser. Any rough surface with the ability to frictionally engage the paper roll surface could be used instead of a serrated gripping plate to stop undesirable or damaging rotation of such a roll.

Interior housing 34 shown in FIG. 2 surrounds the paper roll, and provides for centering ribs 35 and 36 which guide the curved plate 37 while in the dispensing position.

Figure 3:
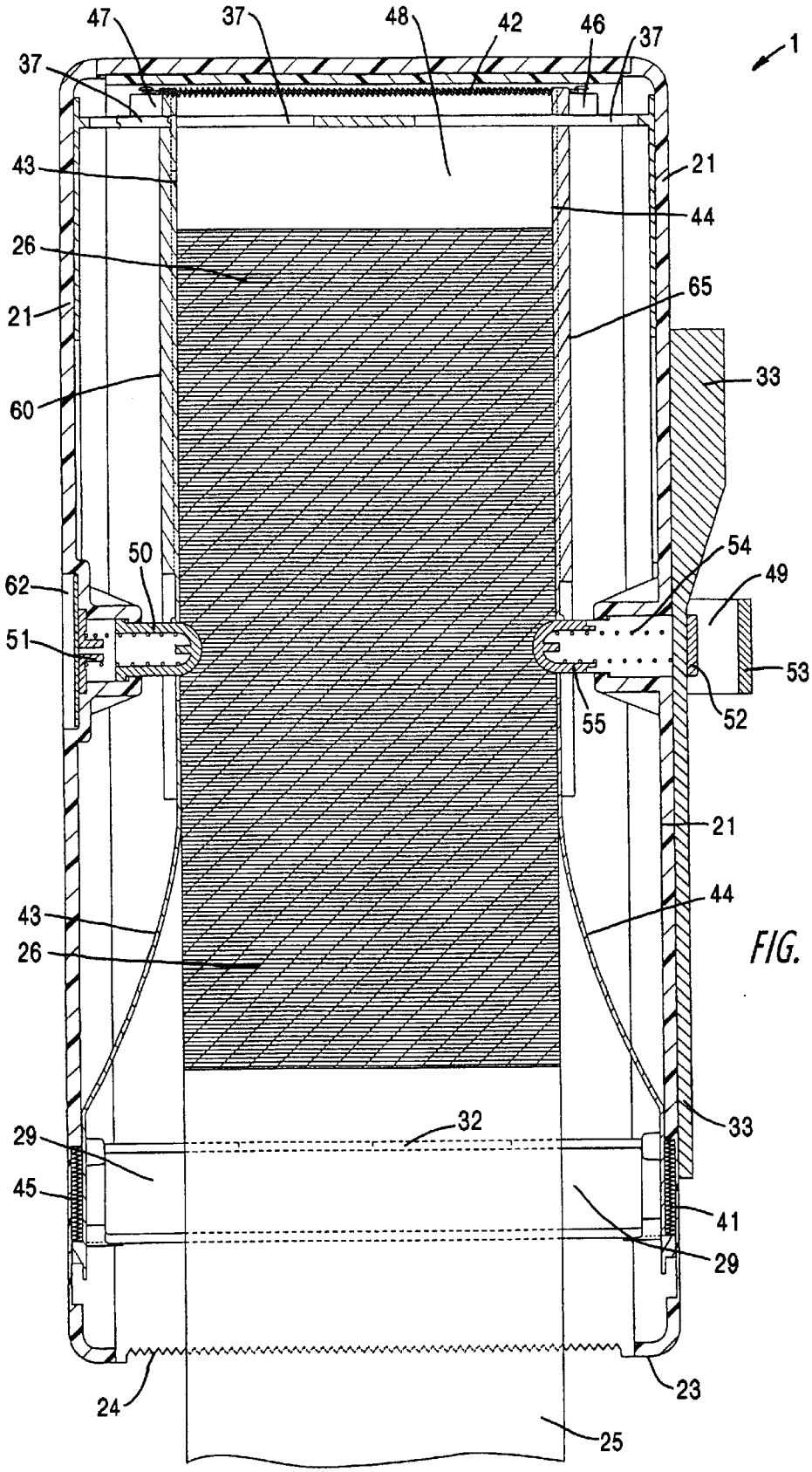
FIG. 3 depicts an end view (cross-sectional) of the dispenser.
Figure 4:
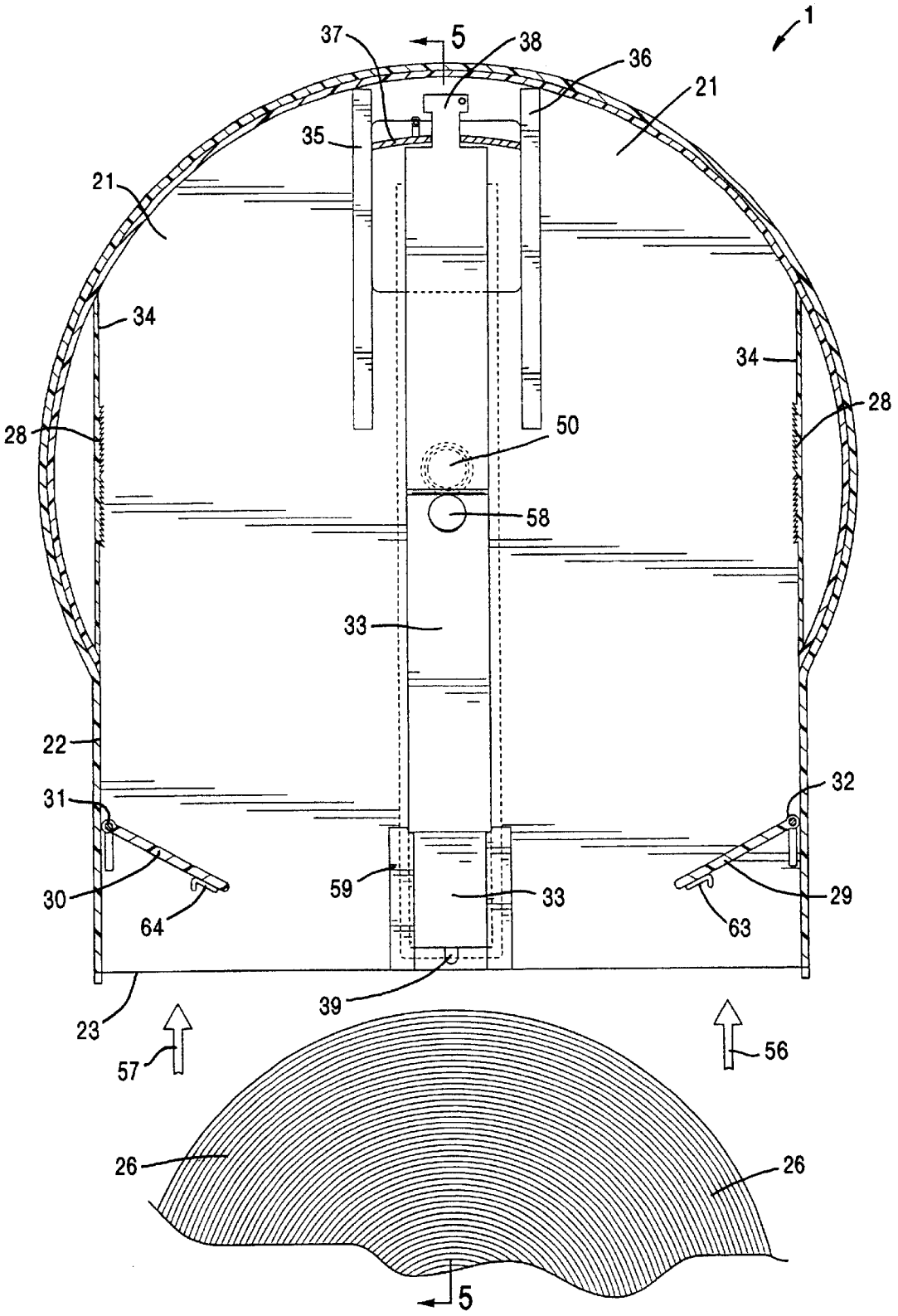
FIG. 4 illustrates a first step in loading a paper roll into the dispenser.

Hub 49 in FIG. 3 provides an axis for holding the paper roll. Lug 53 forms the end of the hub 49. Projection 55, which is bullet-shaped, is held in spring tension by spring 54 and is naturally tensioned to push into the paper roll. Mandrel 52 is connected to the projection 55 such that under some circumstances (seen below in FIGS. 17 and 18) it may be activated to disengage the spring 54 to remove the tension from the bullet-shaped projection 55, facilitating removal of a roll. This removal operation is made possible by slidable movement of release bar 33, as further discussed below in connection with FIGS. 17 and 18. Door supports 63 and 64 support the respective bombay doors, and provide a door stop for the bombay doors. Direction arrows 56 and 57 show the insertion pathway for paper roll 26. Engagement hole 58 provides a pathway for the projection 50 to proceed through the flexible support and into the cavity of the paper roll as will be further discussed below.

FIGS. 6–16 show many of the same numbered features which have been reviewed above.

Figure 6:
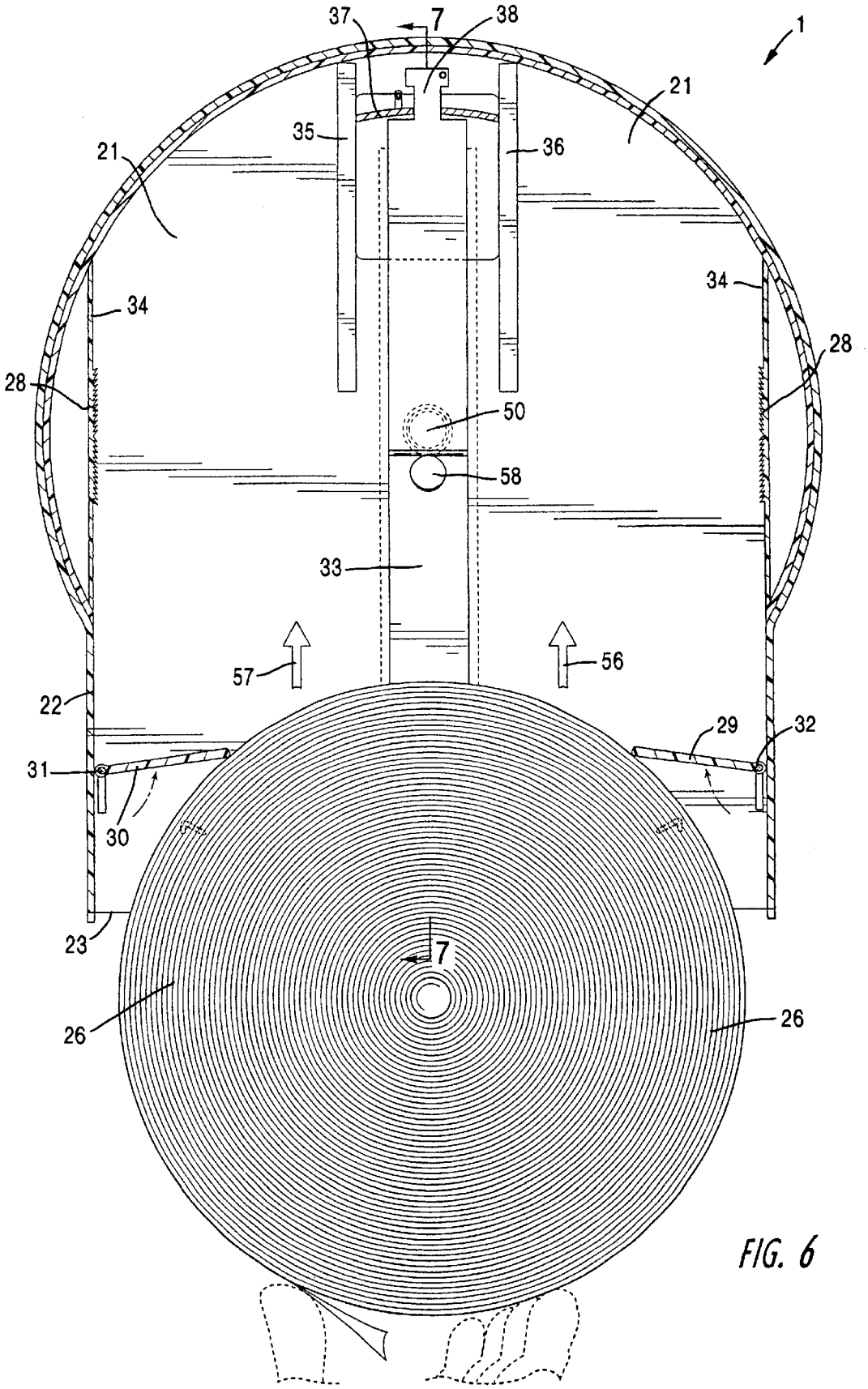
FIG. 6 illustrates a later step showing paper being loaded into the dispenser by pushing upward on the bombay doors.

FIG. 6 shows the manual insertion of a paper roll upwards into the housing of the dispenser, moving bombay doors aside as it rises vertically. The engagement hole 58 is not aligned with the projection 50, but the projection provides a spring tensioned force against the surface of the flexible support in the resting position. The plate 37 is in its lower, resting position.

Figure 7:
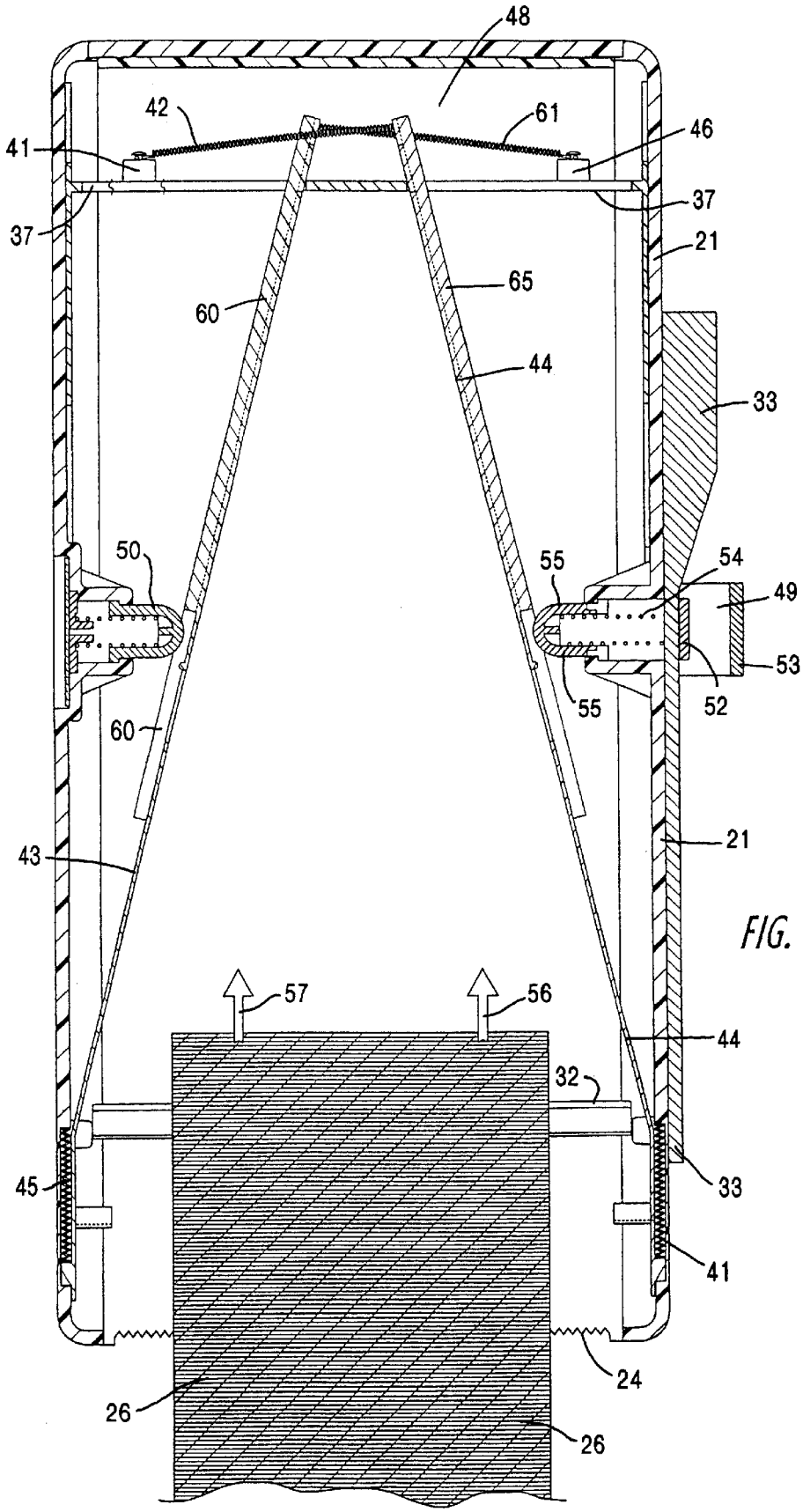
FIG. 7 illustrates a side view with the paper roll being inserted into the dispenser housing.

In FIG. 7, an end view corresponding to FIG. 6 shows the paper roll being inserted into the housing. The flexible supports are in an A-shaped configuration where they are prepared to receive the roll sides against their inner surfaces. Projection 50 and 55 are pressed against the flexible supports by spring action, but do not yet protrude through the hole in each flexible support. Spring 61 provides a tensioning force holding flexible support members 43 and 44 towards the midline of the dispenser. Struts 60 and 65 are intimately attached to support members 43 and 44.

Figure 8:
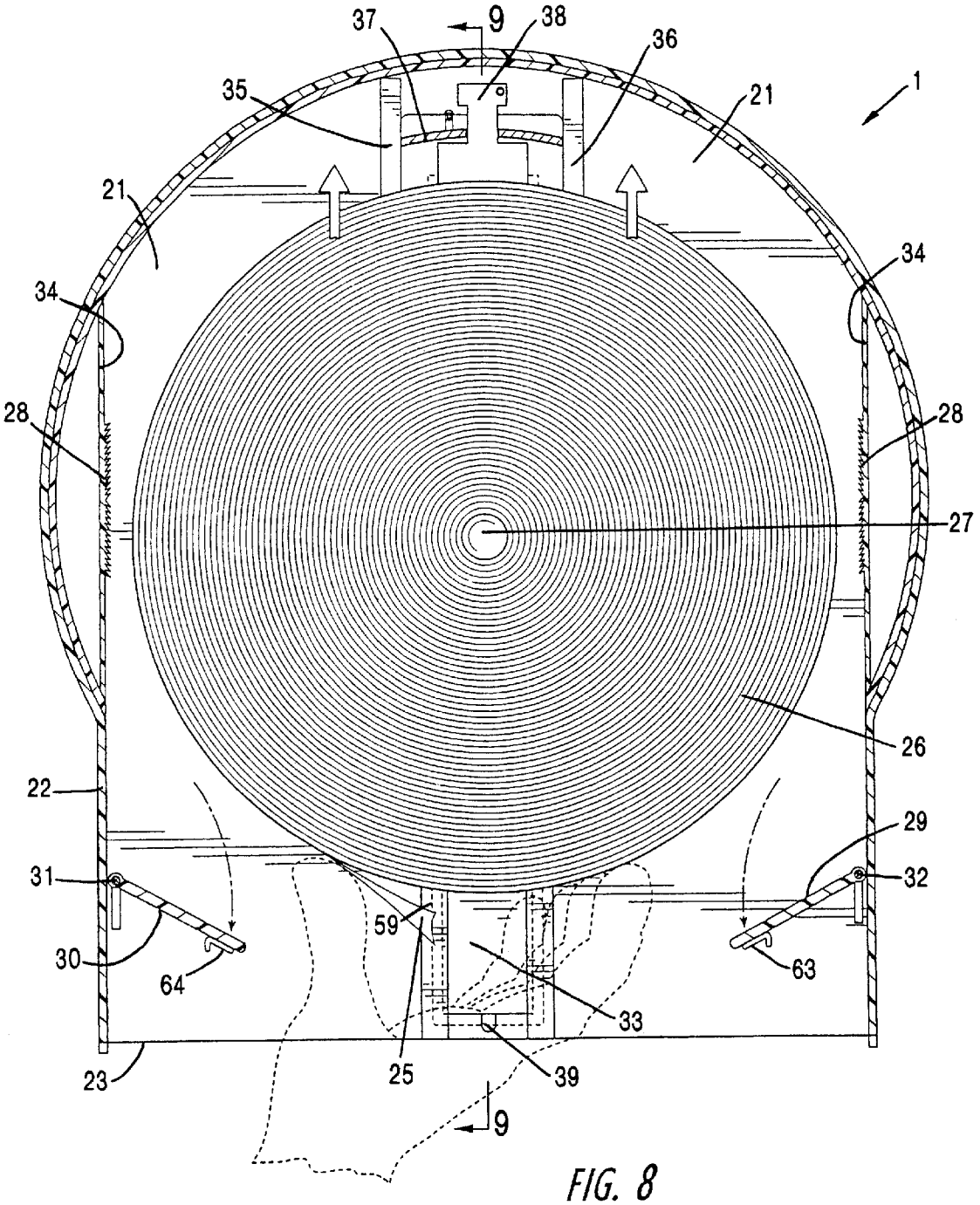
FIG. 8 shows a paper roll inserted into the dispenser, with the bombay doors returned to the closed position.
Figure 9:
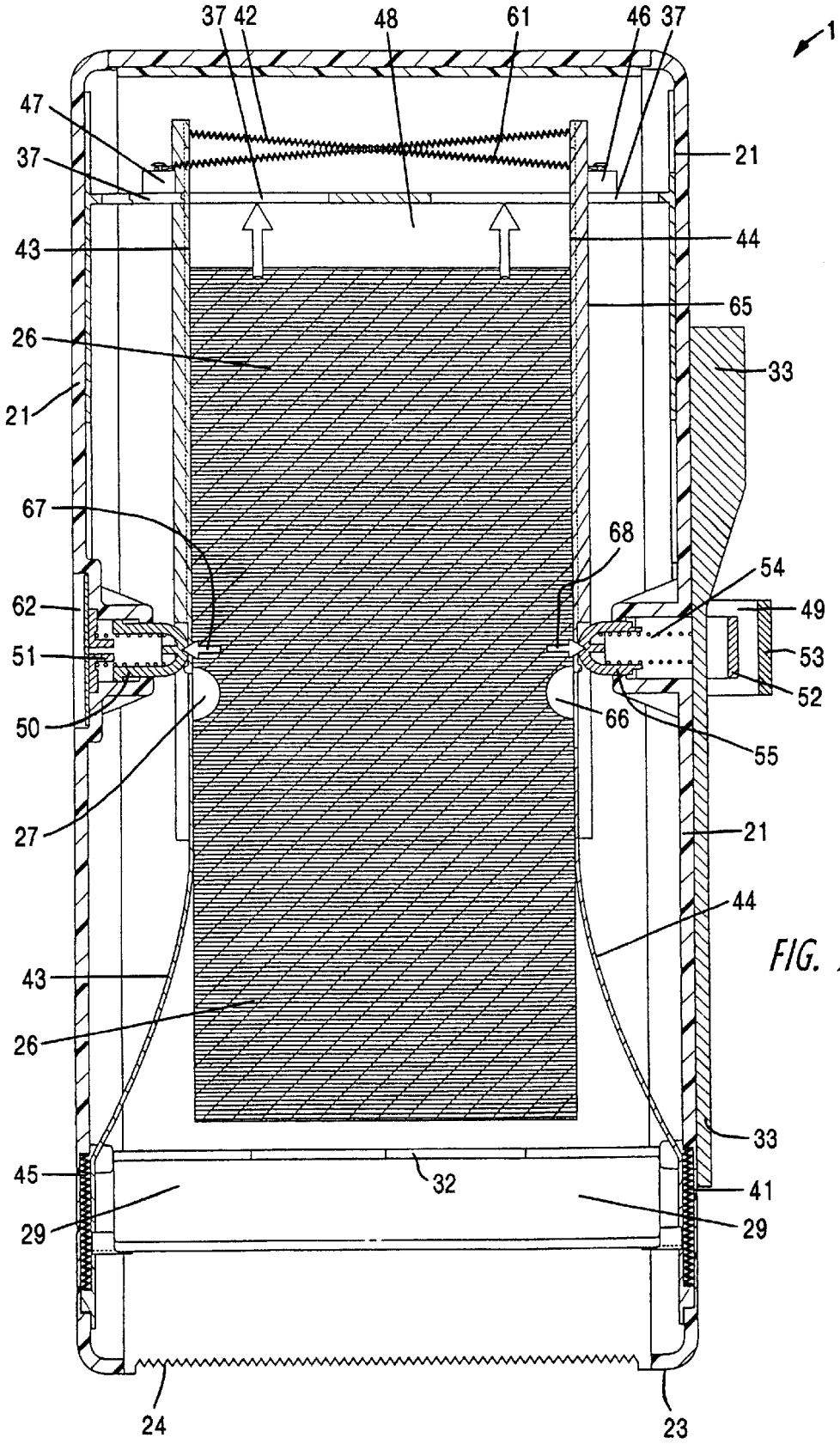
FIG. 9 is an end view showing the paper roll engaging the opposed flexible support members.
Figure 10:
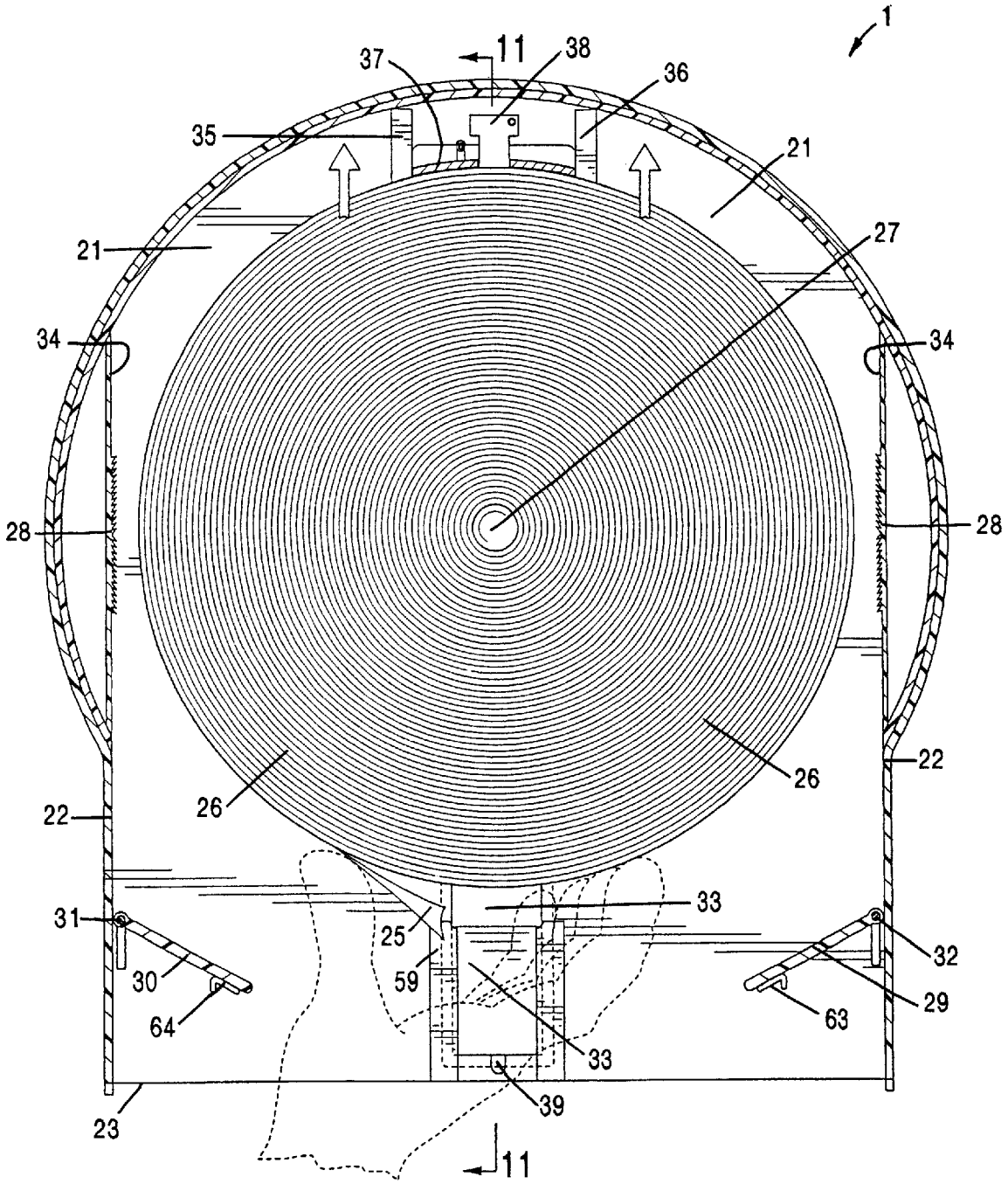
FIG. 10 shows the paper roll inserted into the housing and contacting on its upper surface a plate mechanism.
Figure 11:
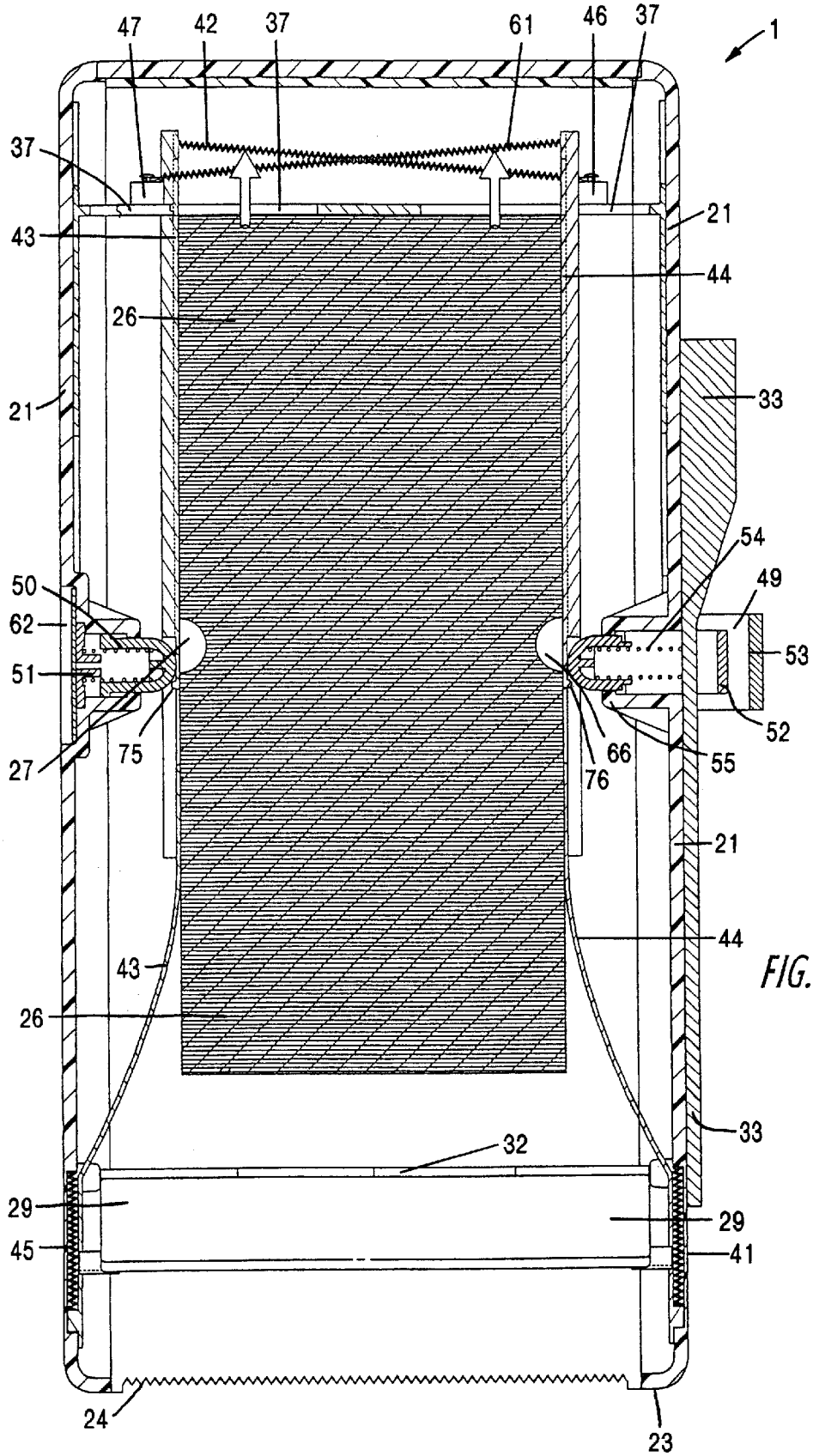
FIG. 11 is an end view corresponding to FIG. 10.
Figure 12:
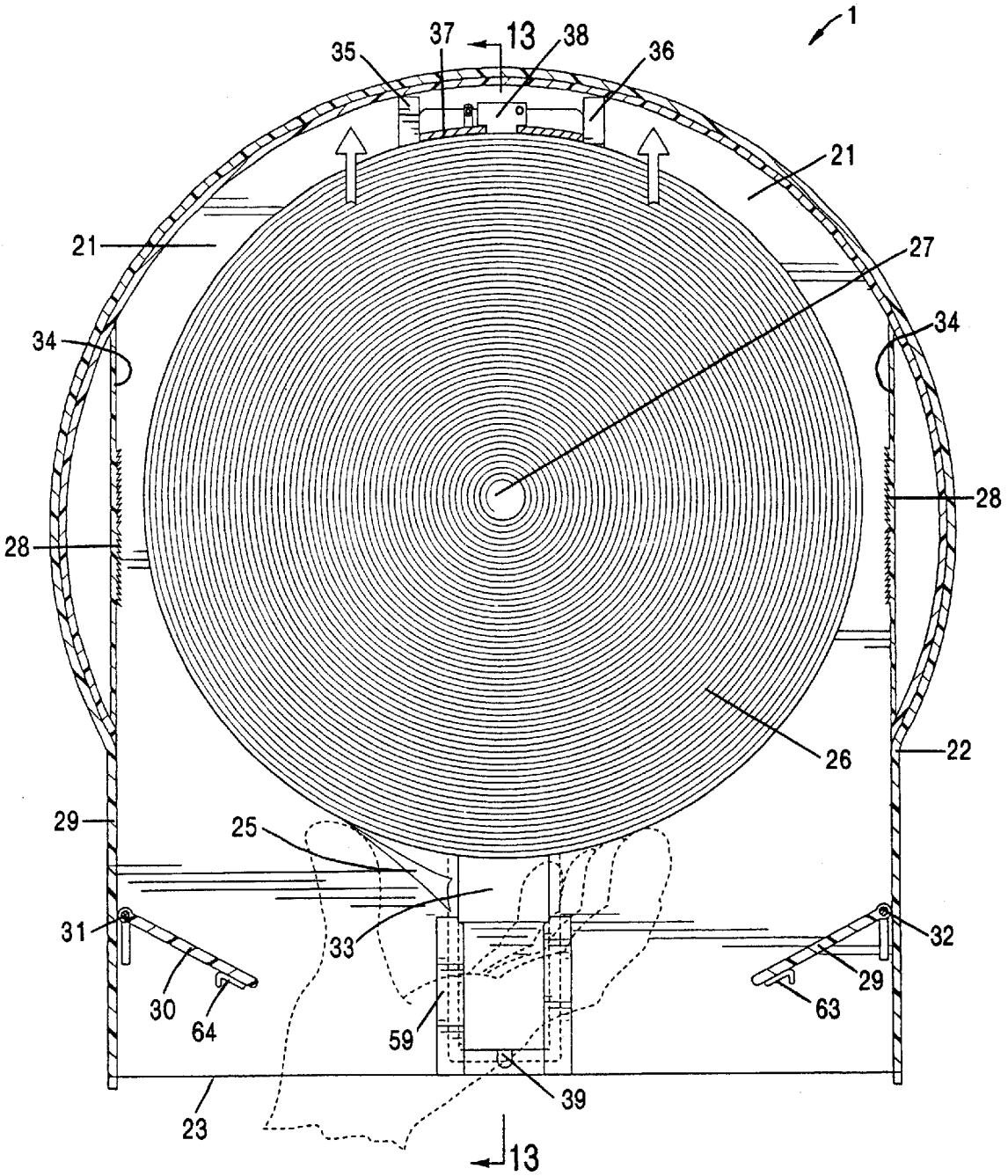
FIG. 12 shows the paper roll further inserted into the housing.
Figure 13:
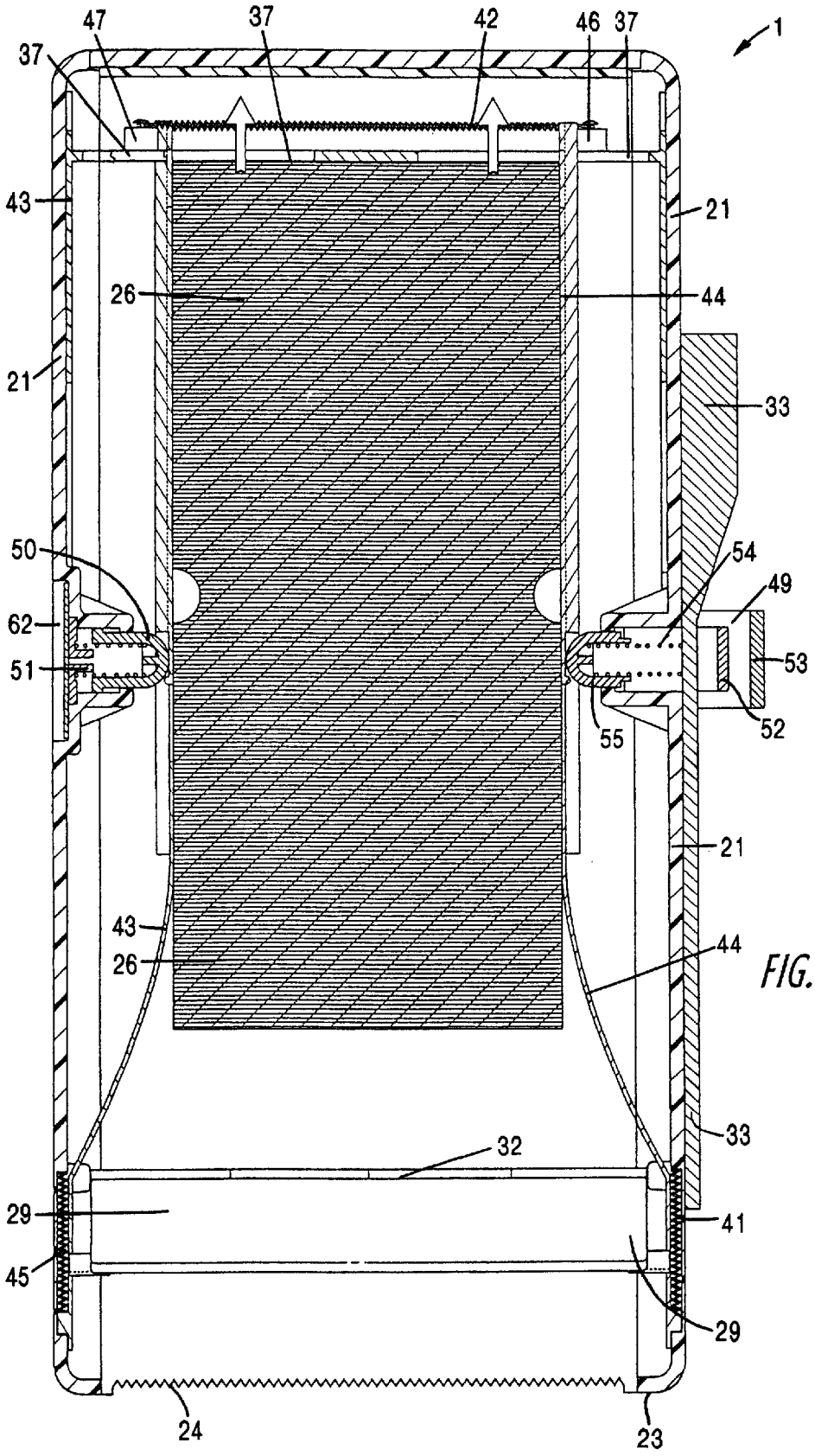
FIG. 13 shows the end view corresponding to FIG. 12 with an upward force being applied to the opposed flexible supports.

FIG. 8 shows the paper roll pushed further into the dispenser. The bombay doors are shown flipped back into their downward positions against door stops 63 and 64, and serve to protect the paper roll from the outside elements and create an appropriate paper path for tearing the paper. FIG. 9 shows an end view of the paper roll in the partially inserted position, in which the direction arrows 67 and 68 show the direction of the force applied by the projections against the flexible supports 43 and 44. In the rear of the housing, the release bar 33 can be seen as it passes through the hub 49 near the lug 53. On the front portion of the housing, a base 62 supports projection 50. Indentations 27 and 66 on either side of the paper roll are configured to receive the projections when the paper roll is pushed further into the housing, as seen in later Figures. FIG. 10 illustrates the paper roll pushed against plate 37 near the top of the housing. FIG. 11 shows an end view of FIG. 10 in which the paper roll contacts the plate 37. One can see the flexible supports extended but retained by notch 75 and notch 76 along the sides of the roll. The projections in FIG. 10 have moved upwards and are nearly in horizontal alignment with indentations 27 and 66. FIG. 12 shows the paper roll pushed further into the housing, and the plate 37 has been lifted vertically, pulling with it the t-bar 38. The effect of this vertical movement of the t-bar is that the support members 43 and 44 begin to move upward once the t-bar rests upon the upper surface of plate 37 (See FIG. 13). The t-bar is intimately connected to the flexible supports, and upward movement of the t-bar causes upward movement of the flexible supports.

Figure 14:
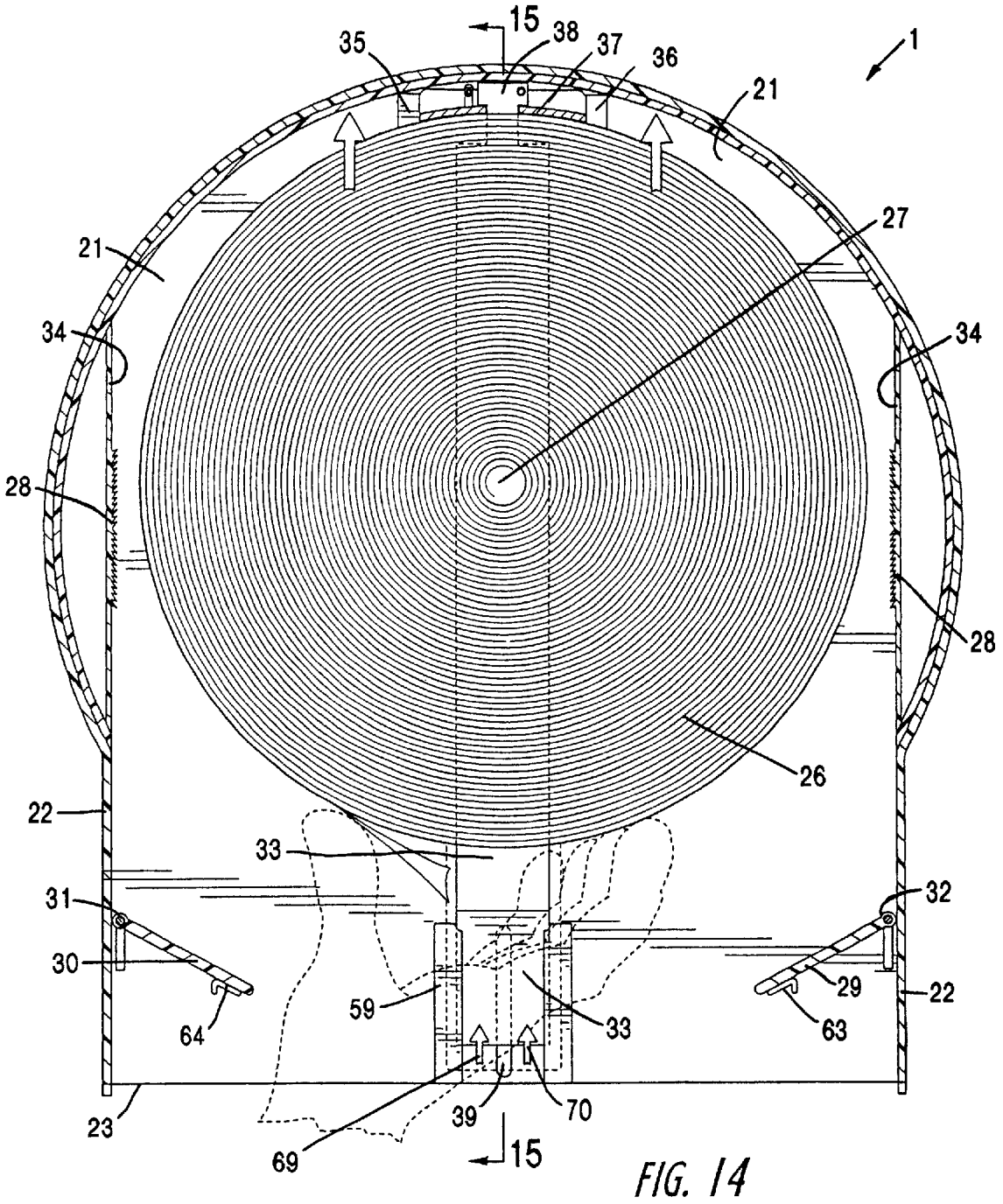
FIG. 14 is a side view showing the paper roll inserted fully into the housing with maximum force applied to the upper plate.
Figure 15:
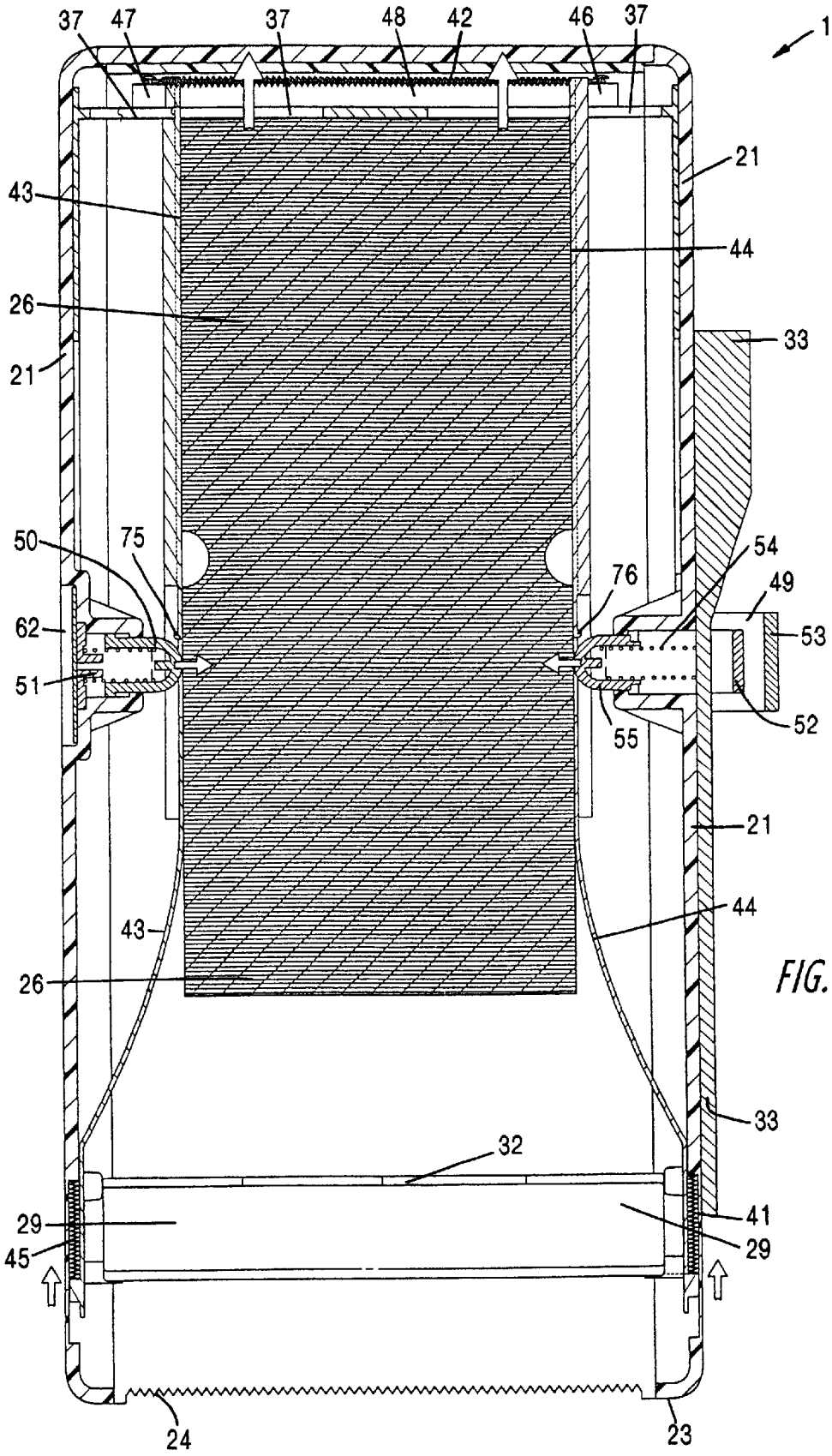
FIG. 15 is an end view corresponding to FIG. 14 showing the paper roll inserted fully into the dispenser.
Figure 16:
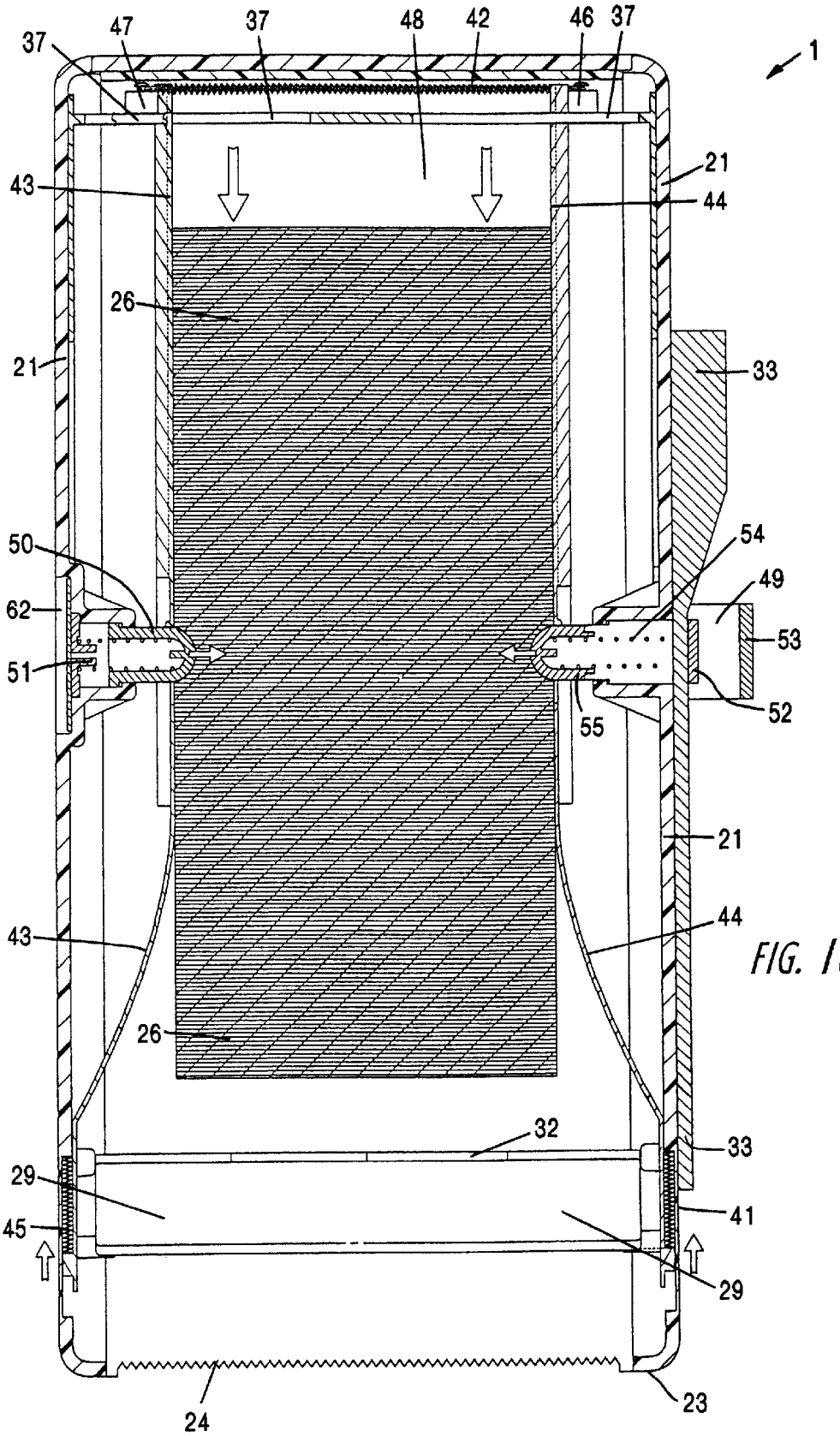
FIG. 16 shows a next step with the paper roll having now dropped into position, the projections engaging each side of the paper roll.

FIG. 14 shows the paper roll pushed completely into the housing, with the plate 37 and t-bar 38 pushed completely to the top of the housing. An upward force along direction arrows 69 and 70 pulls the flexible supports upward. In FIG. 15, one can see notches 75 and 76 on the surface of the flexible supports, which previously were held below the bullet-shaped projections. At this stage of paper roll insertion, the notches have been pulled above the bullet-shaped projections. In FIG. 16, the projections now have aligned with the holes in the flexible supports and are finally engaging the indentations or cavity in each side of the paper roll, supporting the paper roll in the dispenser. The paper roll is now held firmly in place in the dispenser, and typically cannot be removed by simply pulling on the roll from below. The projections firmly engage the indentations in the coreless roll. In the case of a cored roll, the projections engage the space inside the core.

Figure 17:
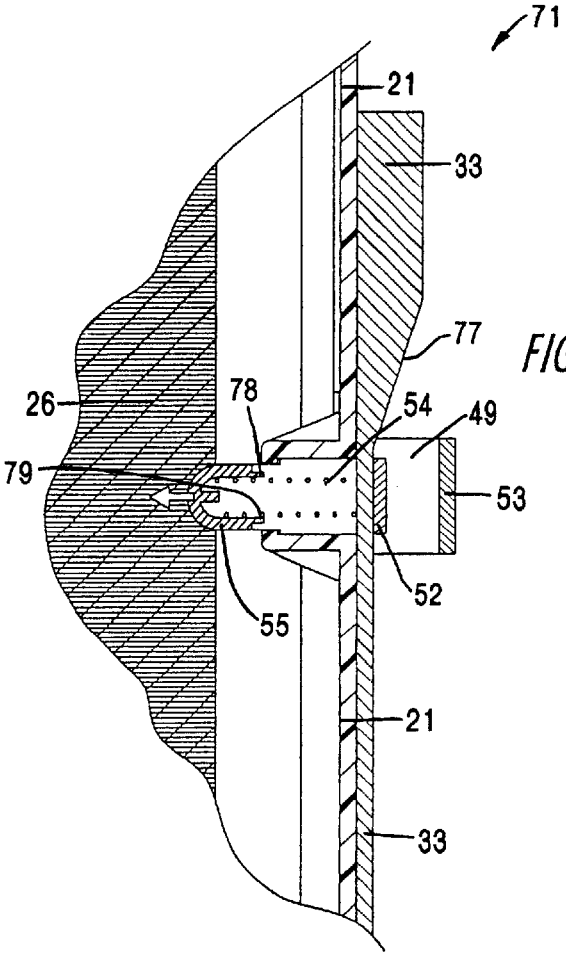
FIG. 17 is a cross-sectional view showing the spring-loaded projection inserted into the side of a paper roll.

FIG. 17 shows the engaged position 71 of the housing in which a paper roll 26 is firmly held by the projection 55. The spring 54 is fully uncoiled so that it can exert pressure against the mandrel 52 on one end, and on the projection 55 on its other end. This causes the projection to be spring-loaded and pressed into the paper roll surface. Release bar 33 is in the "up" position.

Figure 18:
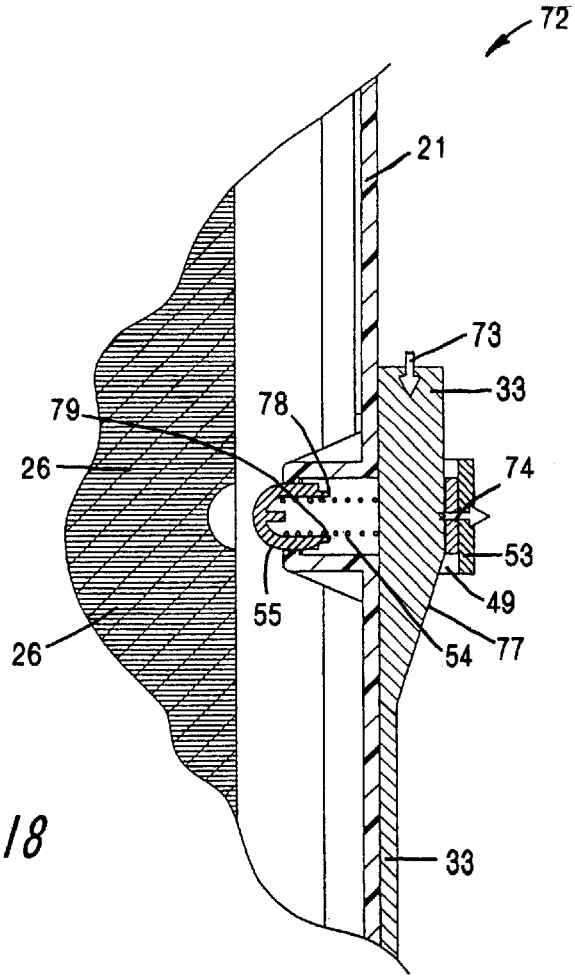
FIG. 18 shows the release bar pulled downward to disable the spring-loaded action of a projection, thereby facilitating removal of the paper roll from the dispenser.

In FIG. 18, release bar 33 has been pulled into the "down" position in which it forces the spring to be isolated from the projection such that the spring 54 no longer pushes the projection 55 into the paper roll 26. The projection end is open, and it has two slots 78 and 79 which are directly in line vertically with one another. When the release bar is pulled into the down position, the track section 77 (see FIGS. 17 and 18) of the release bar is placed through the slots in the projection, slightly compressing the spring 54. In this configuration, the projection is relaxed and no longer applying a horizontal force into the paper roll. Thus, the paper roll may be removed from the dispenser. Removal of a partially used paper roll from the dispenser is especially useful in those situations in which a period of very heavy use of the dispenser is anticipated, and wherein there is likely to be no opportunity to refill the dispenser during the period of heavy use. Other times in which removal of a roll is advantageous is in the case of a contaminated roll.

When a paper roll is depleted, the springs 61 and 42 retract, allowing springs 45 and 41 to retract, returning the flexible support members back to their original position in an "A-shaped" configuration. The entire paper roll loading process takes only about two to three seconds to complete under normal conditions.

The invention is particularly set forth in the appended claims. Further, it should be understood that aspects of the various embodiments disclosed in this specification may be interchanged both in whole or in part without departing from the invention. Furthermore, those of ordinary skill in the art will appreciate that this description is by way of example only, and is not intended to limit the invention as described in the claims.

What is claimed is:

1. A dispenser apparatus for receiving, mounting, and dispensing rolls of a paper product, said dispenser comprising:

a housing defining a generally enclosed interior space for receipt of a roll of the paper product, said housing further comprising an access opening therein through which the roll of paper product is inserted into said housing;

opposed projections disposed within said housing at a dispensing position defining a fixed rotational axis for the roll of paper product within said housing, said projections biased inwardly towards each other and movable between retracted and extended positions;

elongated opposed support members disposed within said housing and defining an insertion pathway therebetween along which the roll of paper product is pushed to insert the roll into said housing to said dispensing position, said support members resiliently biased towards each other along at least a portion of said insertion pathway such that sides of the roll of paper product engage and push said support members apart as the roll is pushed along said insertion pathway; and said projections engaged by said support members such that said projections are held in said retracted position by said support members upon insertion of the roll of paper product and initial movement of said support members, and said projections are released by said support members and movable to said extended position upon further movement of said support members as the roll of paper product is pushed to said dispensing position.

2. The apparatus of claim 1 wherein the projections are spring biased towards said extended position.

3. The apparatus of claim 1 wherein said support members have a first end mounted generally adjacent said access opening and a second opposite end spring biased towards each other such that said insertion pathway has a widest dimension at said first ends adjacent said access opening and a narrowest dimension at said second ends.

4. The apparatus of claim 1 further wherein the roll of paper product is coreless, said projections having a shape and a length so as to extend into indentations defined in respective sides of the coreless roll.

5. The apparatus of claim 1 further wherein said projections are disposed intermediate of said support members and in said extended position said projections extend through openings in said support members.

6. The apparatus of claim 1 in which at least one of said support members comprises at least one opening along its length, wherein in said extended position a respective said projection extends through said opening and into the side of the paper roll product.

7. The apparatus of claim 1 wherein said support members are spring biased towards each other at an end thereof.

8. The apparatus of claim 1 wherein said support members are also mounted for relative longitudinal movement within said housing, said support members moving longitudinally to disengage and release said projections to said extended position upon the roll of paper product being inserted to said dispensing position.

9. The apparatus of claim 8 where said support members comprise engaging structure that contacts and prevents said projections from moving to said extended position until said engaging structure has moved past said projections upon longitudinal movement of said support members.

10. The apparatus of claim 1 wherein said access opening is defined in a lowermost side of said housing, said support members mounted generally vertically within said housing, said insertion pathway being defined in a generally vertical direction.

11. The apparatus of claim 1 additionally comprising a release mechanism disposed on an outer surface of said housing, said release mechanism connected to at least one of said projections so that upon actuation of said release mechanism, said respective projection is caused to disengage from the roll of paper product thereby allowing the roll to be removed from said housing.

12. The apparatus as in claim 11 wherein said projection is spring biased to said extended position, upon actuation thereof said release mechanism releasing the spring biasing force acting on said projection.

13. The apparatus of claim 1 further comprising at least one pivotally mounted door disposed in said access opening, said door movable to allow insertion of the paper roll through said access opening.

14. The apparatus of claim 13 wherein after insertion of the paper roll into said housing, said door moves to a position extending generally across said access opening to support of tail of the paper product for dispensing.

15. A dispenser apparatus for receiving, mounting, and dispensing rolls of a paper product, said dispenser comprising:

a housing defining a generally enclosed interior space for receipt of a roll of the paper product, said housing further comprising an access opening defined generally in a lowermost portion thereof through which the roll of paper product is inserted into said housing;

opposed spring loaded projections disposed within said housing at a dispensing position defining a fixed rotational axis for the roll of paper product within said housing, said projections biased inwardly towards each other and movable between retracted and extended positions;

opposed flexible support members disposed within said housing and defining a generally vertically oriented insertion pathway therebetween along which the roll of paper product is pushed to insert the roll into said housing to said dispensing position, said support members having a first end mounted relative to said housing generally adjacent said access opening and a second end resiliently biased towards each other such that said insertion pathway has a widest dimension generally adjacent said access opening and a decreasing width dimension along the length of said insertion pathway such that sides of the roll of paper product engage and push said support members apart as the roll is pushed along said insertion pathway; and said projections engaged by said support members such that said projections are held in said retracted position by said support members upon insertion of the roll of paper product and initial movement of said support members, and said projections are released by said support members and movable to said extended position upon further movement of said support members as the roll of paper product is pushed to said dispensing position.

16. The apparatus of claim 15 further wherein said projections are disposed intermediate of said support members and in said extended position said projections extend through openings in said support members.

17. The apparatus of claim 15 wherein said support members are also mounted for relative longitudinal movement within said housing, said support members moving longitudinally to disengage and release said projections to said extended position upon the roll of paper product being inserted to said dispensing position.

18. The apparatus of claim 17 where said support members comprise engaging structure that contacts and prevents said projections from moving to said extended position until said engaging structure has moved past said projections upon longitudinal movement of said support members.

19. The apparatus of claim 15 further comprising a release mechanism disposed on an outer surface of said housing, said release mechanism connected to at least one of said projections so that upon actuation of said release mechanism, said respective projection is caused to disengage from the roll of paper product thereby allowing the roll to be removed from said housing.

20. The apparatus of claim 15 further comprising at least one pivotally mounted door disposed in said access opening, said door movable to allow insertion of the paper roll through said access opening.

21. The apparatus of claim 20 wherein after insertion of the paper roll into said housing, said door moves to a position extending generally across said access opening to support of tail of the paper product for dispensing.

* * * * *